United States Patent [19]

Crankshaw

[11] 4,314,869

[45] Feb. 9, 1982

[54] WINE BOTTLE LABELER

[75] Inventor: Michael Crankshaw, Santa Fe Springs, Calif.

[73] Assignee: Label-Aire, Fullerton, Calif.

[21] Appl. No.: 218,600

[22] Filed: Dec. 24, 1980

[51] Int. Cl.[3] ..... B65C 3/16; B65C 9/34

[52] U.S. Cl. ..... 156/215; 156/249; 156/277; 156/285; 156/344; 156/361; 156/364; 156/542; 156/560; 156/DIG. 13; 156/DIG. 26; 156/DIG. 41; 156/DIG. 46

[58] Field of Search ..... 156/285, 344, 277, 249, 156/361, 364, 541, 542, 560, 566, 568, DIG. 13, DIG. 26, DIG. 46, DIG. 47, DIG. 33, DIG. 41

[56] References Cited

U.S. PATENT DOCUMENTS

| | | | |
|---|---|---|---|
| Re. 23,512 | 6/1952 | Von Hofe | 156/DIG. 13 |
| 3,707,422 | 12/1972 | Helm | 156/560 |
| 3,861,986 | 1/1975 | Wochner | 156/542 |
| 3,928,115 | 12/1975 | Kerwin | 156/542 |
| 4,046,613 | 9/1977 | Kucheck et al. | 156/542 |
| 4,089,725 | 5/1978 | Crankshaw et al. | 156/542 |
| 4,124,429 | 11/1978 | Crankshaw | 156/542 |

*Primary Examiner*—Michael G. Wityshyn
*Attorney, Agent, or Firm*—Gordon L. Peterson

[57] ABSTRACT

A method of applying multiple labels to a label receiving surface of an article comprising conveying articles to be labeled to a label applying station, dispensing first and second labels onto a vacuum belt transport, transporting the first and second labels to the label applying station utilizing the vacuum belt transport and wrapping the first and second labels onto different locations on the label-receiving surface of a first of the articles.

7 Claims, 2 Drawing Figures

WINE BOTTLE LABELER

BACKGROUND OF THE INVENTION

The typical wine bottle has a curved, usually cylindrical, peripheral wall. It is often necessary to apply two lables to the peripheral wall of the wine bottle, with each of these labels carrying different information. In the past, this has been accomplished by utilizing two separate wrap-around label applicators, with the first wrap-around label applicator applying the first label and the second wrap-around label applicator applying the second of the labels.

Although this prior labeling technique works satisfactorily, it requires two separate wrap-around label applicators. This doubles the cost of the equipment required for this labeling operation.

SUMMARY OF THE INVENTION

This invention provides a novel method which enables a single label applicator to apply a plurality of labels to different locations on a label-receiving surface of an article to be labeled. In the case of a wine bottle, this may mean, for example, that front and back labels each containing different information are applied to opposite locations on the cylindrical, peripheral wall of the wine bottle utilizing only a single label applicator.

With this invention, articles to be labeled are conveyed through a label applying station, and first and second labels are dispensed onto a vacuum belt transport means which transports the first and second labels to the label applying station. The first and second labels are then wrapped onto different locations on a first of the articles. The different locations may be, for example, on a curved surface of the article. Label wrapping is accomplished utilizing wrap-around labeling techniques which involve contacting the article with an adhesive face of the first label on the vacuum belt transport means to adhere the first label to a first location on the article, rotating the article and contacting the article with an adhesive face of the second label on the vacuum belt transport means to adhere the second label to a second location on the article. Although these steps can be carried out utilizing label applicators of different constructions, a wrap-around label applicator of the type shown in Crankshaw U.S. Pat. No. 4,124,429 is currently preferred.

Although the labels can be provided in different ways, it is preferred to provide them in one or more rows on an elongated backing strip. A product signal is provided as a first of the articles to be labeled approaches the label applying station. In response to the product signal, a first group of labels is dispensed onto the vacuum belt transport means with the adhesive faces of the labels facing outwardly. The first group of labels includes at least two labels from at least one row of labels. The speed of the vacuum belt transport means in relation to the speed with which the labels are dispensed onto the vacuum belt transport means controls the spacing between the labels on the vacuum belt transport means and, hence, the spacing of the labels as they are applied to the article. Typically, to conserve the backing strip, the labels are provided in closely adjacent relationship on the backing strip, and the vacuum belt transport means is run at an increased velocity so as to increase this spacing. The vacuum belt transport means may comprise one or more belts and is utilized to convey the labels from the dispensing station to the label applying station and as a part of the means for wrapping the labels onto the article.

At times, a label must contain information about the product that will be inapplicable after an indeterminable quantity of the product has been labeled. For example, in the case of wine, the vintage date is only applicable for a year. To avoid loss of labels that would result if too many were preprinted with special information, such as the vintage date, it is preferred to print this special information onto the label just prior to the labeling operation.

The typical label applicator dispenses one or more labels in response to each product signal. The label dispensing means responds to the leading or trailing edge of each label or to the gap between labels to determine when the desired number of labels has been dispensed. In the case of labeling wine bottles and other products, the front and back labels typically contain different information. Accordingly, if a label is missing from the backing strip, a wine bottle may receive two front or two back labels. In addition, if a label is missing and if one or more printers is being utilized upstream of the dispensing station to print information on the labels, thereafter the information will be printed on the wrong label.

To prevent printing on the wrong label, the length of movement of the backing strip in response to each product signal is controlled by providing sensing marks on the backing strip which determine the position at which the backing strip must stop. Sensing marks of this type are known and have been used previously to bring about termination of movement of the backing strip, such as in connection with the label applicator shown in Crankshaw and Kucheck U.S. Pat. No. 4,046,613.

The invention, together with further features and advantages thereof, may best be understood by reference to the following description taken in connection with the accompanying illustrative drawing.

DESCRIPTION OF THE PREFERRED EMBODIMENT

Figures 1, 2:
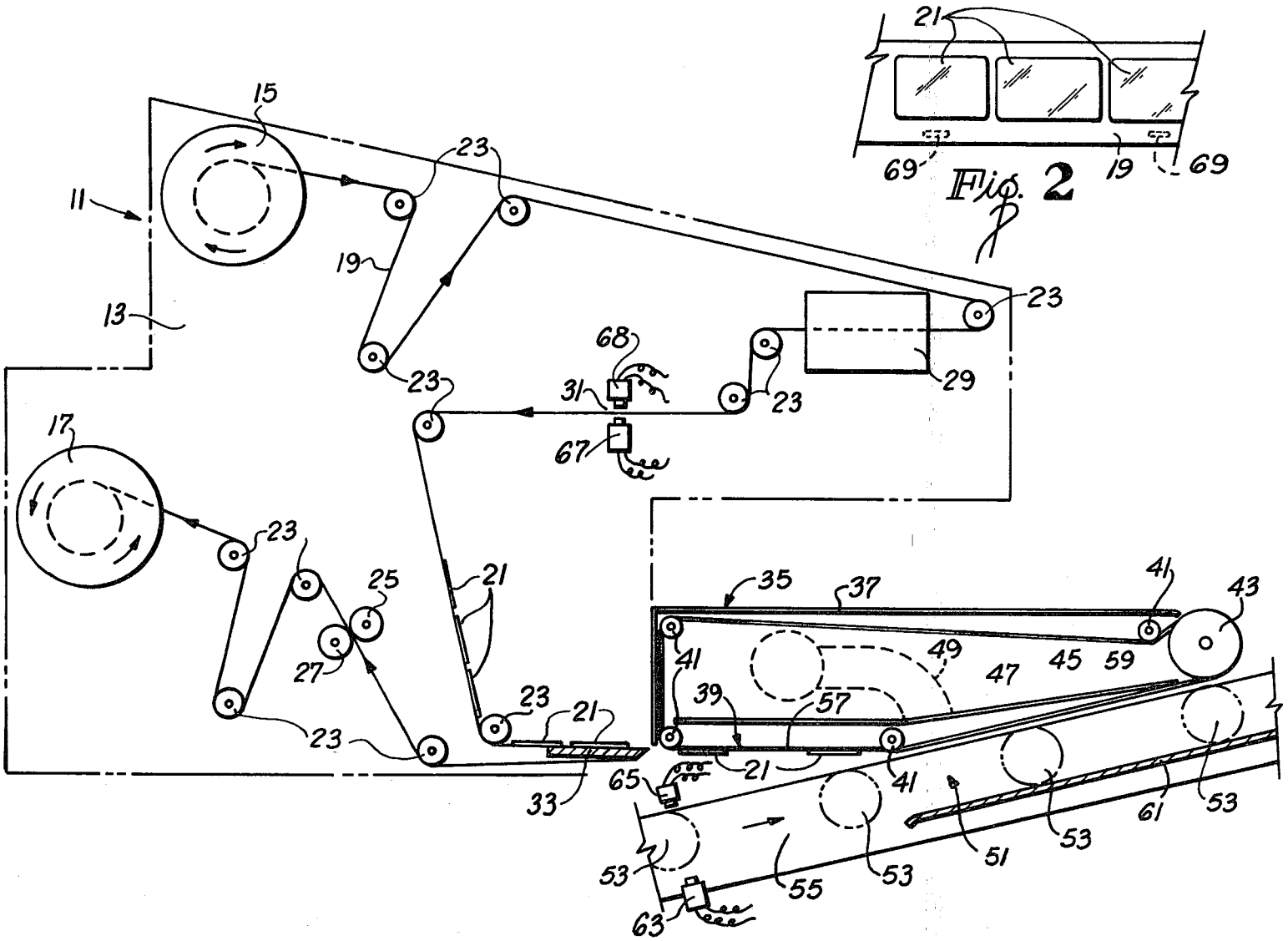
FIG. 1 is a partially schematic plan view of a wrap around label applicator which can be used to carry out the method of this invention.
FIG. 2 is a fragmentary plan view illustrating a section of the backing strip and labels.

FIG. 1 shows a label applicator 11 on which the method of this invention can be carried out. Although the label applicator 11 can be of various different constructions, in the embodiment illustrated, it is very similar to the label applicator shown in Crankshaw U.S. Pat. No. 4,124,429.

The label applicator 11 includes a suitable supporting structure 13 on which a supply reel 15 and a take-up reel 17 are rotatably mounted. A backing strip or web 19 of release paper having labels 21 adhered to it is wound on the supply reel 15 and is guided along a path to the take-up reel 17 by a plurality of guide rollers 23. The backing strip 19 is driven by a drive roller 25 and a cooperating pinch roller 27.

The backing strip 19 and the labels 21 are first moved through a conventional label printer 29 which prints information, such as the vintage date, on every label, every other label or in accordance with some other selected program. The backing strip 19 and the labels 21 are then moved through an index control station 31, the function of which is described hereinbelow, and then over a conventional peeler bar 33 which removes the labels 21 from the backing strip 19 and dispenses them onto a vacuum belt transport means 39. The labels 21 have their adhesive faces facing outwardly on the vacuum belt 39. The backing strip then passes from the peeler bar 33 to the take-up reel 17.

Although the vacuum belt transport means 35 can be of various different constructions, in the embodiment illustrated, it includes a housing 37, an apertured endless vacuum belt 39 mounted for endless movement on the housing 37 by idler rollers 41 and a drive roller 43. A baffle 45 extends from the idler roller 41 adjacent the peller bar 33 to a location closely adjacent the drive roller 43 with the baffle 45 being relatively close to the adjacent section of the vacuum belt 39. Accordingly, the baffle 45 cooperates with the adjacent section of the vacuum belt 39 to define a vacuum chamber 47 which can be partially evacuated by a vacuum pump or other means (not shown) via a conduit 49. Because the vacuum belt 39 is apertured, the vacuum pressure within the vacuum chamber 47 results in a suction force being applied to the labels 21 that. are dispensed onto the vacuum belt 39, and this enables the vacuum belt 39 to transport the labels 21 from a dispensing station at the peeler bar 33 to a labeling station 51 at which the labels are applied to articles 53.

The articles 53, such as wine bottles, are conveyed in sequence through the labeling station 51 by a conveyor 55. A label transport section 57 of the vacuum belt 39 between two of the idler rollers 41 extends essentially from the peeler bar 33 toward the labeling station 51 and the conveyor 55, and a labeling section 59 of the vacuum belt 39 intermediate one of the idler rollers 41 and the drive roller 43 extends parallel to the labeling station 51 and the conveyor 55. With this arrangement, a single endless belt, such as the vacuum belt 39, can be used for transporting the lables 21 to the labeling station 51 and to assist with the wrap around labeling operation. However, these functions can be carried out by separate endless belts as shown, by way of example, in Crankshaw U.S. Pat. No. 4,124,429.

A rail 61 urges the articles 53 against the labeling section 59 to bring about a wrap around labeling function in which the labels 21 at the labeling station are adhered to the peripheral wall of the article. In the example illustrated, two of the labels 21 are wrapped around or onto each of the peripheral walls of the articles 53, and each of such peripheral walls is cylindrical. The vacuum belt 39 has a higher linear velocity than the backing strip 19 and consequently the spacing of the labels 21 on the vacuum belt 39 is greater than the spacing of the labels 21 on the backing strip.

The drive roller 25 indexes the backing strip 19 in response to a product signal received from a product sensor. In the embodiment illustrated, the product sensor includes a light source 63 and a photocell 65 positioned so that the passage of an article 53 to be labeled through a predetermined location interrupts the light beam to provide the product signal. In response to the product signal, the drive roller 25 initiates advancing movement of the backing strip 19.

A light source 67 and photocell 68 read sensing marks 69 (FIG. 2) provided on the backing strip 19 adjacent every other label 21 to stop the drive roller 25. This assures that, for each of the product signals received from the phototcell 65, the backing strip 19 does not move a distance greater than the distance required to dispense two adjacent labels 21. The sensing marks 69 may be, for example, black ink spots which totally block transmission of light from the light source 67 to the photocell 68. The photocell is responsive to this "dark" condition to provide a stop signal for the drive roller 25.

With the method of this invention, the articles 53 are conveyed on the conveyor 55 through the label applying station 51. As one of the articles 53 passes through a predetermined location, a product signal is provided by the photocell 65 to bring about one indexing movement of the drive roller 25 which is sufficient to dispense, in this example, two of the labels 21 in sequence onto the label transport section 57 of the vacuum belt 39. The printer 29 prints on one or more of the labels either on the fly or when the backing strip comes to rest in accordance with known techniques for printing on lablels as part of the label application process.

The labels 21 on the label transport section 57 are spread apart due to the increased velocity of the vacuum belt 39. These two labels are applied to the same one of the articles 53 in a wrap around labeling operation at the labeling station 51. Specifically, the vacuum belt 39 has a higher linear velocity than the conveyor 55 and, because the rail 61 holds the article 53 against the belt 39 at the labeling station 51, the article 53 rotates on its axis as it is moved through the labeling station by the conveyor. This rotational movement of the article 53 and the spacing of the labels 21 on the belt 39 enable a single label applicator to wrap two separate labels onto different locations of the same article.

Although an exemplary embodiment of the invention has been shown and described, many changes, modifications and substitutions may be made by one having ordinary skill in the art without necessarily departing from the spirit and scope of this invention.

I claim:

1. A method of applying a plurality of labels to a label-receiving surface of an article, said method comprising:

conveying articles to be labeled through a label applying station with each of the articles having a label-receiving surface;

providing labels with each of the labels having an adhesive face and an information-carrying face adapted to have information thereon;

dispensing first and second of the labels onto a vacuum belt transport means with the adhesive faces of the first and second labels facing outwardly;

transporting the first and second labels to the label applying station with the vacuum belt transport means; and contacting a first of the articles at the labeling station with the adhesive face of the first label on the vacuum belt transport means to adhere the first label to a first location on the label-receiving face of the first article, rotating the first article and contacting the label-receiving surface of the first article with the adhesive face of the second label on the vacuum belt transport means to adhere the second label to a second location on the label-receiving surface of the first article whereby the first and second labels are applied to different locations on the label-receiving surface of the first article.

2. A method as defined in claim 1 wherein said step of providing includes providing the labels adhered to a backing strip, providing a signal in response to the first article reaching a predetermined location, said step of dispensing includes removing only the first and second labels from the backing strip and dispensing the first and second labels onto the vacuum belt transport means in response to such signal.

3. A method as defined in claim 2 wherein the vacuum belt transport means includes a vacuum belt and including moving the vacuum belt at a velocity which is greater than the velocity of the labels as the labels are dispensed onto the vacuum belt to thereby space the first and second labels farther on the vacuum belt than such labels were spaced apart when on the backing strip.

4. A method as defined in claim 1 wherein said step of providing includes providing the labels on a supply reel and said step of dispensing includes moving the labels from the supply reel to a dispensing location and said method includes printing on at least one of the first and second labels intermediate the supply reel and the dispensing location.

5. A method as defined in claim 1 wherein said step of providing includes providing the labels on a backing strip, said method includes providing a product signal in response to the first article reaching a predetermined location, said step of dispensing includes moving the backing strip a predetermined distance in response to the product signal to remove a first group of the labels from the backing strip and to dispense the first group of labels in sequence onto the vacuum belt transport means, said first group of labels including said first and second labels, and providing the first label with different information on its information-carrying face than on the information-carrying face of the second label.

6. A method as defined in claim 5 including printing information on the information-carrying face of the first label prior to said step of dispensing.

7. A method as defined in claims 5 or 6 wherein the backing strip is provided with sensing marks and including sensing the sensing marks to move the backing strip said predetermined distance in response to said product signal.

* * * * *